US008393823B2

(12) United States Patent
Roberts

(10) Patent No.: US 8,393,823 B2
(45) Date of Patent: Mar. 12, 2013

(54) MANHOLE COVER SECURITY AND REMOVAL

(75) Inventor: David Roberts, Andover, MN (US)

(73) Assignees: David Roberts, Andover, MN (US); Merlyn Hubers, Rock Valley, IA (US); Jean Hubers, Rock Valley, IA (US)

( * ) Notice: Subject to any disclaimer, the term of this patent is extended or adjusted under 35 U.S.C. 154(b) by 276 days.

(21) Appl. No.: 12/145,674

(22) Filed: Jun. 25, 2008

(65) Prior Publication Data

US 2009/0324328 A1 Dec. 31, 2009

(51) Int. Cl.
*E02D 29/14* (2006.01)

(52) U.S. Cl. ..... 404/25

(58) Field of Classification Search ..... 404/25, 404/26; 52/20; 137/371; 70/208
See application file for complete search history.

(56) References Cited

U.S. PATENT DOCUMENTS

| | | | | | |
|---|---|---|---|---|---|
| 822,562 | A | | 6/1906 | Tucker | |
| 2,363,567 | A | | 11/1944 | Blakeman | |
| 2,622,750 | A | * | 12/1952 | Ehlers | 414/619 |
| 3,281,880 | A | * | 11/1966 | Bender | 15/93.2 |
| 4,323,329 | A | * | 4/1982 | Chlad | 414/737 |
| 4,902,165 | A | | 2/1990 | Embree | |
| 4,964,755 | A | | 10/1990 | Lewis et al. | |
| 5,035,336 | A | * | 7/1991 | Schmitz et al. | 212/166 |
| 5,139,619 | A | * | 8/1992 | Schoonover | 202/270 |
| 5,697,729 | A | | 12/1997 | Bowman | |
| 5,956,079 | A | * | 9/1999 | Ridgley | 348/89 |
| 6,164,898 | A | | 12/2000 | Taylor | |
| 6,550,294 | B2 | | 4/2003 | Garguilo | |
| 6,881,007 | B2 | | 4/2005 | Dennis | |
| 6,945,742 | B2 | | 9/2005 | Roberts | |
| 7,503,743 | B1 | * | 3/2009 | Friedrich | 414/684.3 |
| 7,544,035 | B1 | * | 6/2009 | Friedrich | 414/684.3 |
| 7,832,239 | B2 | * | 11/2010 | Kozuka et al. | 70/162 |
| 7,878,035 | B2 | * | 2/2011 | Yamaguchi et al. | 70/161 |
| 2004/0042886 | A1 | | 3/2004 | Roberts | |
| 2007/0269267 | A1 | | 11/2007 | Roberts | |
| 2008/0022730 | A1 | * | 1/2008 | Dietrich et al. | 70/158 |

* cited by examiner

*Primary Examiner* — Thomas B Will
*Assistant Examiner* — Abigail A Risic
(74) *Attorney, Agent, or Firm* — Fredrikson & Byron, P.A.

(57) ABSTRACT

A manhole cover includes a security device, preferably located beneath an upper surface thereof. A cover removing apparatus includes a magnetic element to hold the cover, when a pin of the apparatus is engaged with the security device of the cover. A push force, which may be applied through a port in the upper surface of the cover, for example, by the pin member, can deform, and thereby unlock, a spring-loaded locking member of the security device. The security device may further include at least one elongate member, which is caused to move from a first position to a second position, by the push force, in order to disengage the cover from a manhole, so that the cover may be removed from the manhole.

18 Claims, 5 Drawing Sheets

MANHOLE COVER SECURITY AND REMOVAL

TECHNICAL FIELD

The present invention pertains to manhole covers and more particularly to both the security and removal thereof.

BACKGROUND

Manholes typically provide access, from the street level, to underground infrastructure, such as water mains, sewers or other utility networks. Manhole covers prevent pedestrians and vehicles from falling into the manholes, yet may be removed from covering the manholes when access is desired. Although typical unsecured manhole covers, which are formed from cast iron, can be somewhat difficult to pry open, those determined on gaining access to the manholes can overcome this difficulty.

In recent years, securing access to manholes has become a higher priority in order to block a potential avenue for terrorist attacks. A number of secure manhole cover designs have been proposed in the past, but there is still a need for improved manhole covers that include security devices, as well as the methods and apparatus for releasing and removing these secured covers from the manholes, for example, to provide legitimate access for the repair and maintenance of portions of the underground infrastructure.

BRIEF DESCRIPTION OF THE DRAWINGS

The following drawings are illustrative of particular embodiments of the invention and therefore do not limit the scope of the invention. The drawings are not to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention. Examples of constructions, materials and dimensions are provided for selected elements, and all other elements employ that which is known to those of skill in the field of the invention. Those skilled in the art will recognize that many of the examples provided have suitable alternatives that can be utilized.

Figure 1:
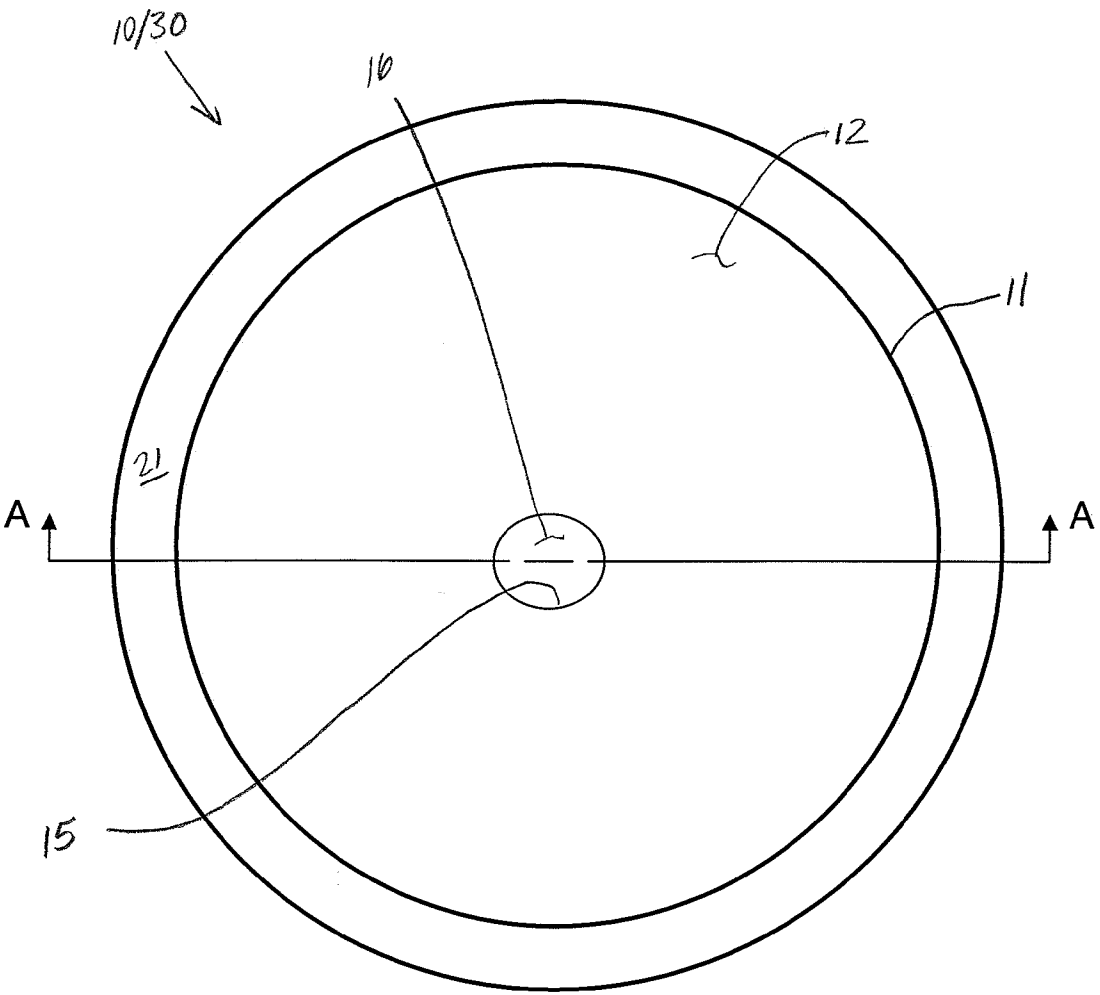
FIG. 1 is a top plan view of a cover covering a manhole, according to some embodiments of the present invention.

FIG. 1 is a top plan view of a cover 10/30, according to some embodiments of the present invention. FIG. 1 illustrates cover 10/30 being mounted within a rim 21 of a manhole, in order to cover the manhole, and including a perimeter edge 11 and an upper surface 12 in which a port 15 is formed. A section line A-A is shown extending through cover 10/30 and rim 21, and FIG. 2 is a schematic cross-section view through section line A-A, according to a first group of cover embodiments, represented as a cover 10, while FIGS. 3A-B are schematic cross-section views through section line A-A, according to a second group of cover embodiments, represented as a cover 30.

Figure 2:
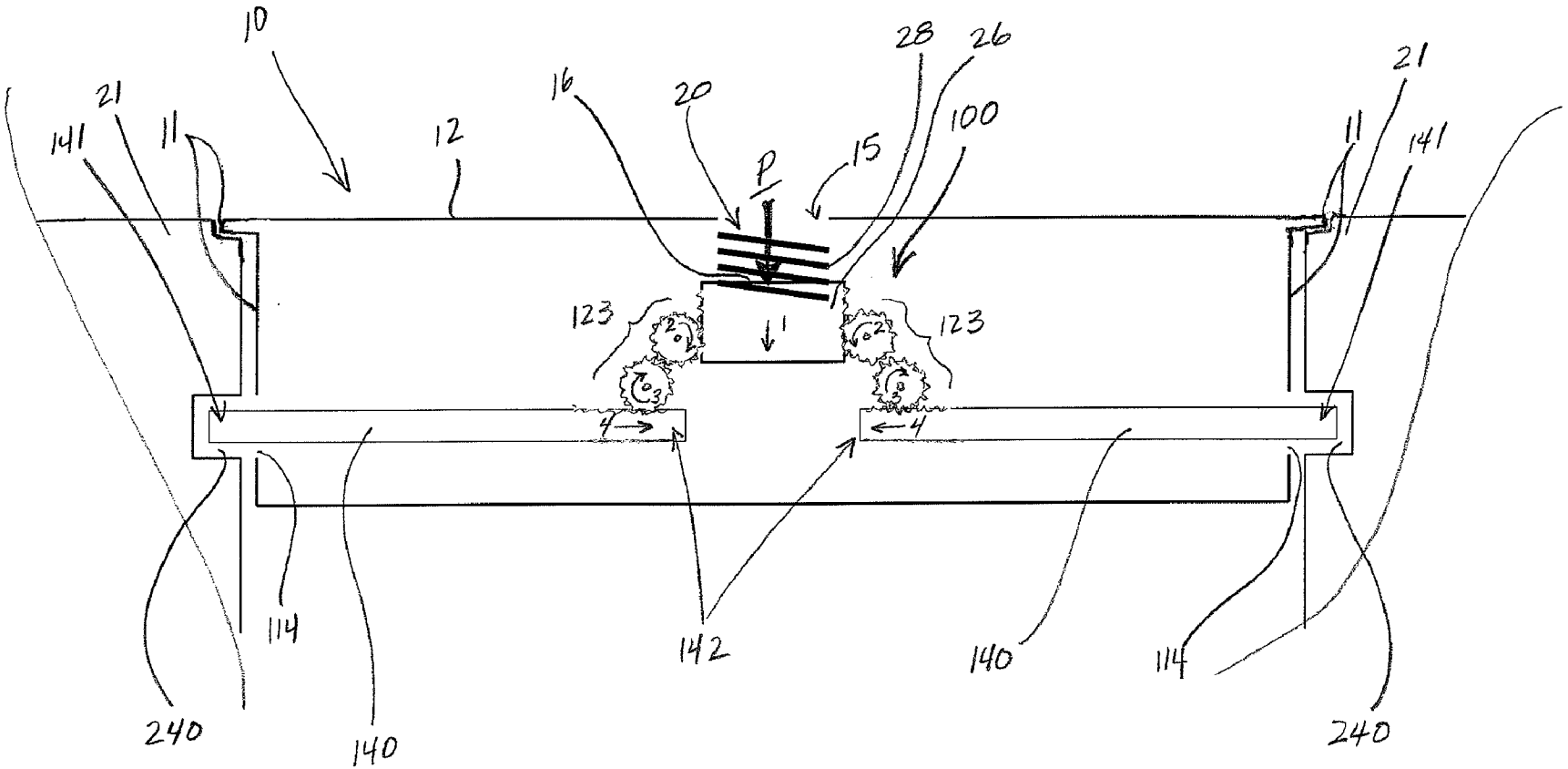
FIG. 2 is a schematic cross-section view through section line A-A of FIG. 1, according to a first group of embodiments.
Figure 3A:
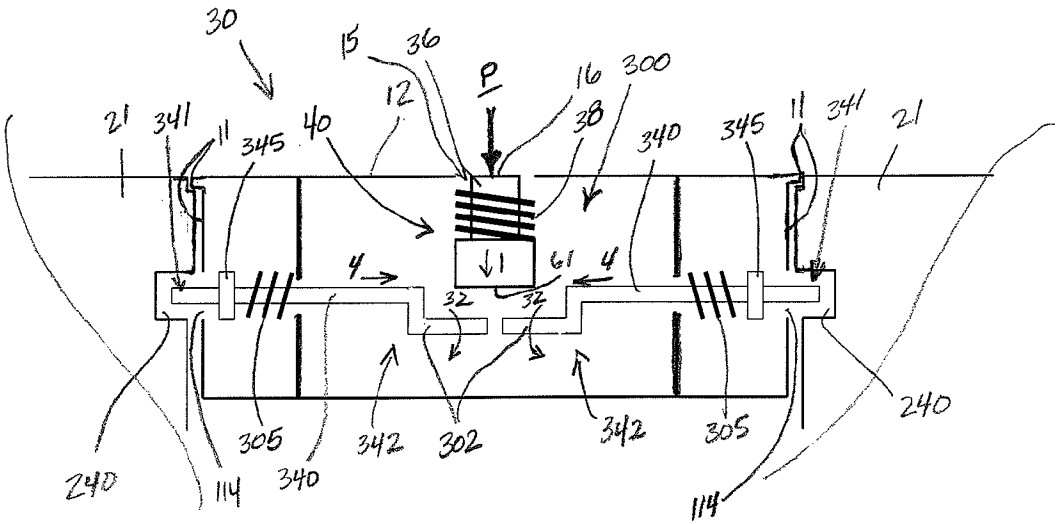
FIGS. 3A-B are schematic cross-section views through section line A-A of FIG. 1, according to a second group of embodiments.
Figure 3B:
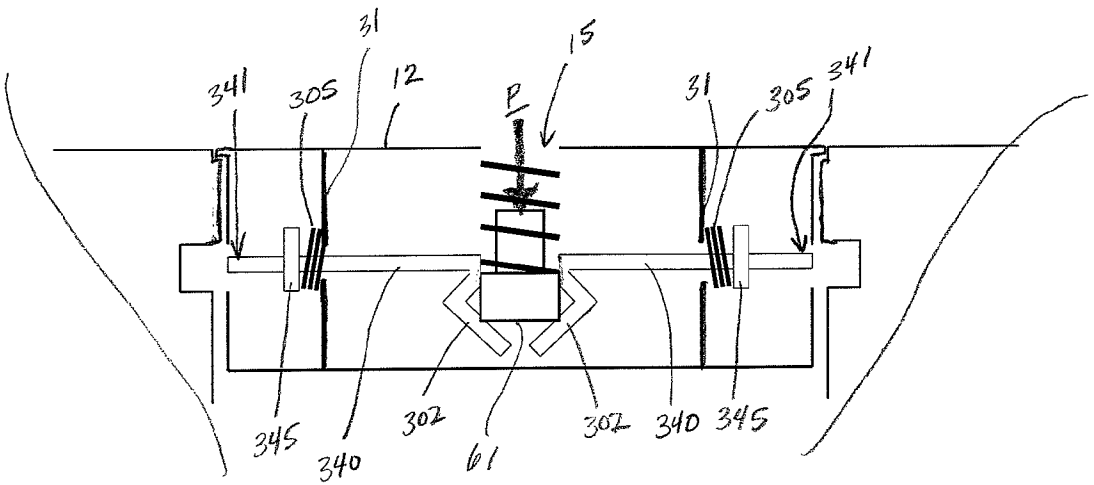

FIGS. 2 and 3A-B illustrate perimeter edge 11 of each of covers 10, 30 mating within rim 21, and each of covers 10, 30 including a security device 100 and 300, respectively, which is mounted within perimeter edge 11 and beneath upper surface 12. Each security device 100, 300 is shown including elongate members 140 and 340, respectively, and a spring-loaded locking member 20 and 40, respectively, wherein port 15 is approximately aligned with each locking member 20, 40 Each locking member 20, 40 is shown including a spring 28, 38 coupled to a plug member 26, 36, wherein each plug member 26, 36 includes an interface surface 16 to receive a push force that is applied, for example, per an arrow P, from above upper surface 12, through port 15, and approximately perpendicular to a plane of port 15. According to embodiments illustrated by FIG. 2, prior to applying the push force, when spring 28 is un-deformed and ends 141 of elongate members 140 are engaged in recesses 240, interface surface 16 is recessed below upper surface 12 of cover 10; while, according to embodiments illustrated by FIGS. 3A-B, prior to applying the push force, when spring 38 is un-deformed and ends 341 of elongate members 340 are engaged in recesses 240, interface surface 16 is approximately flush with upper surface 12 of cover 30. It should be noted that, according to yet further embodiments, interface surface 16 protrudes from upper surface 12 before the push force is applied thereto. According to some preferred embodiments, a diameter of port 15 is no greater than approximately two inches.

According to the illustrated embodiments, when the push force, preferably greater than approximately 1,000 pounds, is applied against interface surface 16, for example, per arrow P, to deform locking member 20, 40, the respective elongate members 140, 340 are caused to move from a first position to a second position. According to an exemplary embodiment, spring 28, 38 is formed from stainless steel and has a spring, or force constant of approximately 1,000 lb/ft. At the first position, ends 141 and 341 of members 140 and 340, respectively, protrude from adjacent portions of perimeter edge 11, through openings 114, over a length that is necessary to engage with recesses 240 in rim 21, for example, as is illustrated in FIG. 2, for members 140, and in FIG. 3A, for members 340. At the second position, ends 141, 341 either protrude over a shorter length, than at the first position, so as to disengage from recesses 240, or do not protrude from the adjacent portions of perimeter edge 11 at all, being either flush with edge 11 or withdrawn inwardly therefrom, for example, as is illustrated in FIG. 3B. According to some embodiments, each elongate member 140, 340 is formed from a stainless steel rod having a diameter, at end 141, 341, ranging from approximately ½ inch to approximately 1 inch, for example, depending upon a diameter and a weight of cover 10/30. In the first position, ends 141, 341, preferably extend into recesses 240 over a distance ranging from approximately ½ inch to approximately 1 inch. It should be noted that, although FIGS. 2 and 3A-B illustrate each security device 100, 300 including a pair of elongate members 140, 340, embodiments of the present invention are not so limited, and alternate embodiments may include a security device that has a single elongate member, or a security device that has any number of elongate members greater than two.

With reference to FIG. 2, security device 100 is shown including a gear drive 123, which interfaces with spring-loaded locking member 20 and with elongate members 140. According to the illustrated embodiment, when plug member 26 is moved, per arrow 1, by the push force, the linear translation of member 26 is converted to rotational translation, in gear drive 123, per arrows 2 and 3, which rotational translation drives a linear translation of elongate members 140, per arrows 4, in order to retract ends 141 from recesses 240, and, thereby, release the engagement with rim 21 (the aforementioned second position). Once the push force is removed from locking member 20, spring 28 raises plug member 26 to drive each gear of gear drive 123 in opposite directions, which thereby drive a linear translation of elongate members 140, in opposite directions, so that ends 141 reengage in recesses 240 (the aforementioned first position).

With reference to FIGS. 3A-B, security device 300 is shown including pivot arms 302 coupled to elongate members 340. According to the illustrated embodiments, pivot arms 302 are located below a lower surface 61 of plug member 36, for engagement therewith, when the push force is applied, and are linked to elongate members 340 such that, when lower surface 61 engages pivot arms 302, pivot arms 302 draw elongate members 340 inward, per arrow 4, in order to retract ends 341 from recesses 240, and, thereby, release the engagement with rim 21. Those skilled in the art will appreciate the linkages necessary to couple pivot arms 302 to elongate members 340, so for simplicity in illustration, the detail of these are not shown. Once the push force is removed from locking member 40, a spring bias acting on each elongate member 340 may cause members 340 to move back into engagement with recesses 240. According to embodiments illustrated by FIGS. 3A-B, each elongate member 340 includes a flange 345 and the spring bias for each member 340 is formed by a spring member 305 acting between the corresponding flange 345 and an interior sidewall 31 of cover.

With further reference to FIGS. 2 and 3A-B, it may be appreciated that interface surface 16 is accessed through a center of spring 28, 38, and that spring 28, 38 is stretched in order to unlock locking member 20, 40. However, according to alternate embodiments, locking members 20, 40 are configured such that the push force applied against interface surface 16 compresses spring 28, 38 in order to unlock locking members 20, 40. In such an alternate configuration, spring 28, 38 may be located below plug member 26, 36.

Turning now to FIGS. 4 and 5A-C, embodiments of an apparatus that may be used to remove manholes covers, for example, including those which include security devices according to embodiments of the present invention, will be described.

Figure 4:
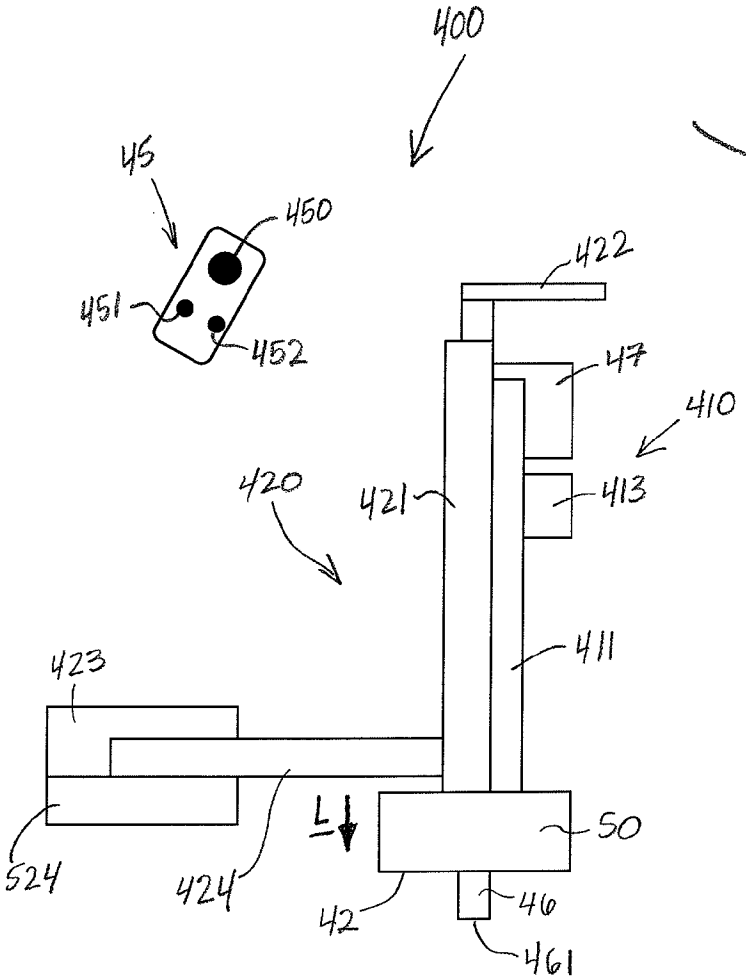
FIG. 4 is a schematic elevation view of a cover-removing apparatus, according to some embodiments of the present invention, which may be used to remove any of the manhole cover embodiments shown in FIGS. 1-3B.

FIG. 4 is a schematic elevation view of a cover-removing apparatus 400, according to some embodiments of the present invention, which may be used to remove any of the manhole cover embodiments shown in FIGS. 1-3B. FIG. 4 illustrates apparatus 400 including a magnetic element 50, preferably an electromagnet, a pin member 46, which is positioned below a lower surface 42 of magnetic element 50, and a structure 420, which supports magnetic element 50 and pin member 46. FIG. 4 further illustrates structure 420 including a mechanism 410, for raising and lowering electromagnet 50 and pin member 46, and an arm 424 extending between mechanism 410 and an optional vehicle mounting element 423. Optional mounting element 423 can be coupled to a vehicle utilizing, for example, a commercial riser, which can be inserted into a common two inch receiver hitch. According to the illustrated embodiment, mechanism 410 includes a ram assembly 411, which is vertically mounted to a frame 421, and is preferably driven, to move electromagnet 50 and pin 46 up and down, by a hydraulic power pack 413; power pack 413 may be powered by a 12 volt power system of a vehicle. Electromagnet 50 may be coupled to ram assembly 411 by a locking pin held in place with a hitch pin clip, however, other methods of attachment are fully contemplated without departing from the spirit and scope of the invention. Pin member 46 may be reversibly mounted to electromagnet 50, or to a portion of structure 420 that extends through a bore in electromagnet 50, for example, via a threaded interface, so that pin member 46 may be removed for replacement with another, and/or for flexibility to use apparatus to remove manhole covers, which do not include security devices of the present invention. It should be noted that electromagnet 50 and pin member 46 may be incorporated into apparatus that employ other types of raising and lowering mechanisms, such as pneumatic or electric or gas powered motors in conjunction with a winch system.

With reference back to FIGS. 2 and 3A-B, in conjunction with FIG. 4, it may be appreciated that pin member 46 is employed by apparatus 400 to apply the push force, per arrow P. It should be noted that pin member 46, for this purpose, may be incorporated into any of the manhole cover-removing apparatus, which are described in commonly-assigned U.S. Pat. No. 6,945,742 and in commonly-assigned and co-pending patent application 2007/0269267, which are hereby incorporated, by reference, herein. Pin member 46 may be mounted to extend along a central axis of electromagnet 50, or may be offset from the central axis. According to an exemplary embodiment, electromagnet 50 has an approximately circular perimeter edge, an outer diameter of approximately eight inches and is adapted to apply a magnetic adhesion force of at least 5,000 pounds in order to lift and hold a manhole cover against lower surface 42 thereof. According to some preferred embodiments, mounted pin member 46 has a length, which may range from approximately ½ inch to approximately 1 inch, wherein the length is defined from lower surface 42 of electromagnet 50 to an end 461 of pin member 46, and a diameter of approximately one inch along the length. Pin member 46 is preferably formed from cast iron and, according to some embodiments, includes a ⅜ inch male thread for coupling with a threaded bore of electromagnet 50.

Figure 5A:
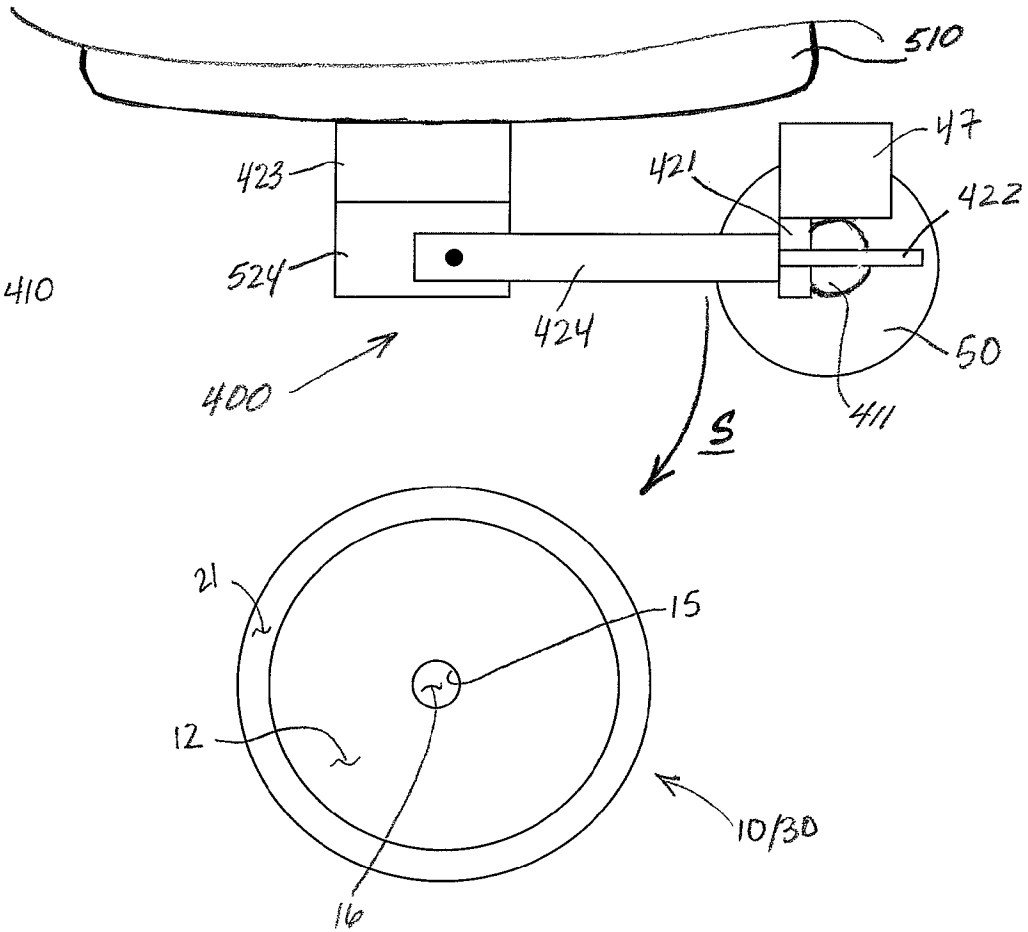
FIG. 5A is a schematic top plan view of the apparatus, shown in FIG. 4, positioned adjacent to the manhole cover.
Figure 5C:
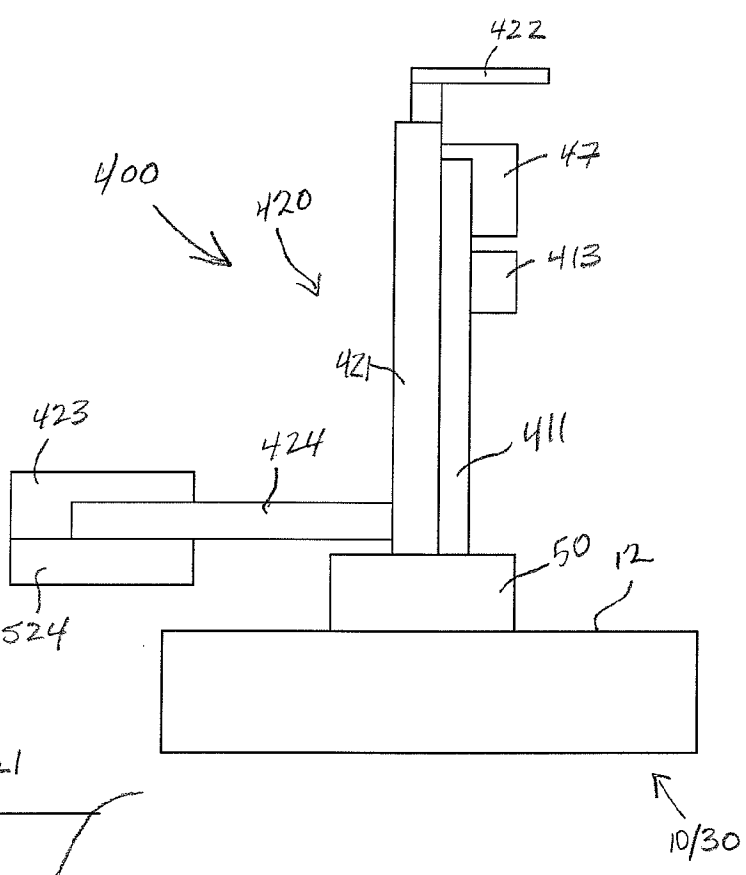
FIG. 5C is a schematic elevation view of the apparatus, shown in FIG. 4, lifting the manhole cover.
Figure 5B:
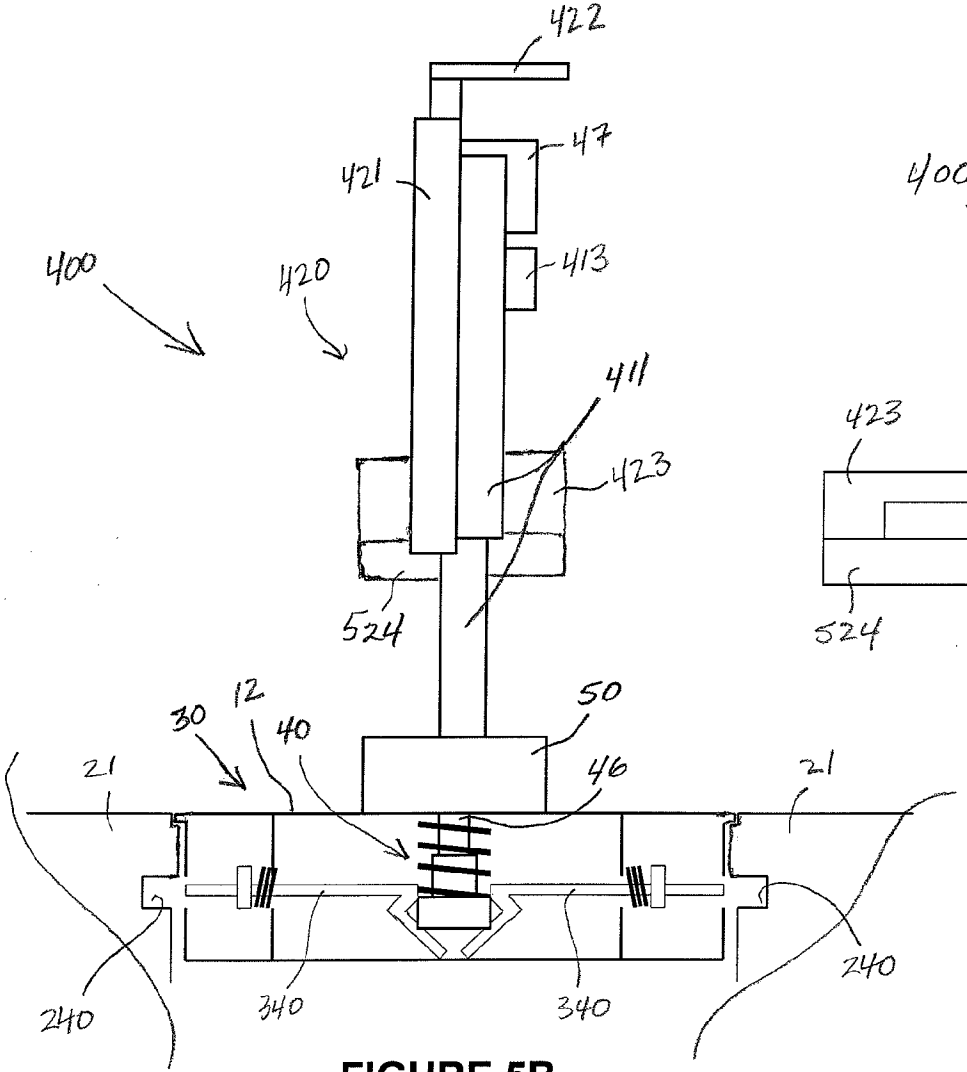
FIG. 5B is a schematic elevation view, including a partial cut-away section, of the apparatus, shown in FIG. 4, engaged with the manhole cover.

FIGS. 5A-B schematically illustrate a sequence of steps, according to some methods of the present invention, for removing cover 10/30 from a manhole, using apparatus 400. FIG. 5A is a top plan view of apparatus 400 positioned adjacent to cover 10/30, wherein ram assembly 411 is positioned in proximity to an uppermost end of travel, for example, as is illustrated in FIG. 4. According to some preferred embodiments, arm 424 is pivotably joined to a base member 524 of structure 420, so that apparatus 400 may be held in proximity to a side 510 of a vehicle, to which apparatus 400 is mounted, when not in use, and then may be swung out from side 510, for example, per arrow S, when the vehicle is positioned adjacent to cover 10/30, in order to position electromagnet 50 over cover 10/30. An optional handle 422 is shown for manually swinging arm 424, but, alternatively, the swinging motion of arm 424 may be automated, according to methods known to those skilled in the art. However, it should be noted, that apparatus 400 need not include swing arm 424, and, according to alternate embodiments, wherein electromagnet 50 and pin member 46 are relatively rigidly fixed within apparatus 400, and apparatus 400 is relatively rigidly fixed to a vehicle, the vehicle may be maneuvered in order to position electromagnet 50 and pin member 46 for unlocking and lifting cover 10/30. Cover 10/30 may be marked, for example, with spray paint, prior to positioning electromagnet 50, in order to provide a visual reference for positioning pin member 46 over port 15. According to some preferred embodiments, apparatus 400 includes a video camera 47 by which the relative locations of cover 10/30 and apparatus 400 may be monitored, for example, from within a cab of the vehicle to which apparatus 400 is mounted; although FIGS. 4 and 5A-C show video camera 47 mounted to frame 421, camera may be mounted to any other portion of apparatus 400 to provide alternative perspectives for the monitoring.

Once electromagnet 50 and pin member 46 are properly positioned over cover 10/30, either manually or automatically, ram assembly 411 is activated to lower electromagnet 50, for example, per arrow L (FIG. 4), over cover 10/30. According to some preferred embodiments, pin member 46 is rigidly fixed with respect to electromagnet 50, so that pin member 46 is simultaneously lowered for passage through port 15 in upper surface 12 of cover 10/30, when lower surface 42 of electromagnet 50 comes into close proximity with upper surface 12. According to preferred embodiments of the present invention, the hydraulic force of mechanism 410, which lowers ram assembly 411, may be up to approximately 2,000 pounds, and, thus, is more than adequate to push pin member 46 against interface surface 16 of locking member 20/40, in order to deform, and, thereby, unlock, locking member 20/40 of cover 10/30, for example, as is illustrated, for cover 30, in FIG. 5B. Simultaneously, or subsequently, electromagnet 50 is energized, for example, by a 12 volt power system of the vehicle to which apparatus 400 is mounted, in order to hold cover 10/30 against surface 42 thereof. According to some alternate embodiments, when lower surface 42 is close enough to upper surface 12, electromagnet 50 may be energized to bring surfaces 42, 12 together, and to cause pin member 46 to push against interface surface 16 of locking member 20/40, in order to deform, and, thereby, unlock, locking member 20/40 of cover 10/30. As previously described, and as shown in FIG. 5B, for cover 30, when locking member 40 is deformed, elongate members 340 are retracted from engagement within recesses 240, of manhole rim 21, so that cover 30 may be lifted away from the manhole by apparatus 400, when electromagnet 50 is energized.

FIG. 5C is a schematic elevation view of apparatus 400 lifting cover 10/30. Cover 10/30 may be lifted out from the manhole by apparatus 400, via a reversal of the hydraulic force to raise ram assembly 411, and held by apparatus 400, via the sustained magnetic force of energized electromagnet 50. Thus, it may be appreciated that apparatus 400 is able to apply the push force necessary to hold spring-loaded locking member 20/40 in the unlocked position while simultaneously applying a lifting force to raise cover 10/30, which may weigh between approximately 80 and 100 pounds, and also to, subsequently, lower cover 10/30 back into engagement with rim 21 of the manhole. Once apparatus 400 has lifted cover 10/30, arm 424 may be swung back, for example in a direction opposite to that of arrow S (FIG. 5A), to move cover 10/30 away from the manhole; alternately, if apparatus 400 does not include swing arm 424, the vehicle, to which apparatus 400 is attached, may be moved to move the lifted cover 10/30 away from the manhole.

With reference back to FIG. 4, apparatus 400 preferably further includes a handheld remote control device 45. FIG. 4 illustrates device 45 including a pair of buttons 451 and 452, one of which, when pressed, sends a signal that causes ram assembly 411 to be lowered, and the other of which, when pressed, sends a signal that causes ram assembly 411 to be raised. FIG. 4 further illustrates device 45 including an on/off switch 450, for alternately energizing and de-energizing electromagnet 50. Although, not shown, device 45 may also include a button for controlling the swing of arm 424. Of course any implementation of a remote control for the cover-removing methods performed by apparatus 400, as described herein, are within the spirit and scope of the present invention.

In the foregoing detailed description, the invention has been described with reference to specific embodiments. However, it may be appreciated that various modifications and changes can be made without departing from the scope of the invention as set forth in the appended claims. For example, although apparatus 400 is described herein as being useful for removing covers 10, 30, the use of apparatus 400 need not be so limited; apparatus 400 may be used to remove any manhole cover which includes a security device with which pin member 46 may be engaged, and thereby release the security device, so as to disengage the cover from the manhole for lifting therefrom. Similarly, methods of the present invention, for removing covers, according to embodiments of the present invention, need not necessarily employ embodiments of cover-removing apparatus described herein.

I claim:

1. A method for removing a manhole cover from a manhole with a cover-removing apparatus, the manhole cover being locked to the manhole by a security device of the manhole cover, the method comprising:

pushing a pin member of the cover-removing apparatus through a port in the manhole cover and against a spring-loaded locking member of the security device to move an elongate member of the locking member from a first position to a second position, the first position locking the manhole cover to the manhole, the second position unlocking the manhole cover from the manhole and allowing removal of the manhole cover;

energizing a magnetic element of the cover-removing apparatus to apply a magnetic force for holding the cover against the magnetic element;

raising the magnetic element to lift the held cover from engagement within the manhole; and locking the spring-loaded locking member of the security device of the cover by moving the pin member away from the locking member thereby causing the elongate member of the security device to move from the second position to the first position.

2. The method of claim 1, wherein the pushed pin member applies a force of greater than approximately 1,000 pounds to unlock the spring-loaded member.

3. The method of claim 1, further comprising lowering the magnetic element to engage the held cover within the manhole; and de-energizing the magnetic element to disable the magnetic force holding the cover and thereby releasing and locking the held cover.

4. The method of claim 3, wherein the first position is an extended position wherein an end of the elongate member is engaged within a recess in a rim of the manhole; and the second position is a retracted position wherein the end of the elongate member is dis-engaged from the recess in the rim of the manhole.

5. The method of claim 4, wherein the pin member is inserted through a port of the cover when pushed against the locking member.

6. The method of claim 5, wherein the port extends through an upper surface of the cover and pushing is in a direction approximately perpendicular to a plane of the port.

7. The method of claim 5, further comprising aligning the pin member with the port of the cover, by viewing on a monitor, video feed from a camera of the cover-removing apparatus.

8. The method of claim 4, further comprising rotating an arm of the cover-removing apparatus, to which the magnetic element is attached, in order to perform at least one of:

positioning the magnetic element over the cover;

displacing the held cover from over the manhole;

positioning the cover held by the magnetic element over the manhole; and displacing the magnetic element away from the cover.

9. The method of claim 4, wherein pushing, energizing, de-energizing, moving, lowering and raising are controlled from a remote location.

10. The method of claim 7, further comprising aligning the held cover with the rim of the manhole, by viewing on the monitor, video feed from the camera of the cover-removing apparatus.

11. A method for removing a manhole cover from a manhole with a cover-removing apparatus, the manhole cover being locked to the manhole by a security device of the manhole cover, the method comprising:

pushing a pin member of the cover-removing apparatus through a port in the manhole cover and against a plug member of the security device to move an elongate member of the locking member from a first position to a second position, the first position locking the manhole cover to the manhole, the second position unlocking the manhole cover from the manhole and allowing removal of the manhole cover;

energizing a magnetic element of the cover-removing apparatus to apply a magnetic force for holding the cover against the magnetic element;

raising the magnetic element to lift the held cover from engagement within the manhole; and removing the pin member from the port in the manhole cover thereby causing the elongate member to move from the second position to the first position.

12. The method of claim 11, further comprising lowering the magnetic element to engage the held cover within the manhole; and de-energizing the magnetic element to disable the magnetic force holding the cover and thereby releasing and locking the held cover.

13. The method of claim 12, wherein the first position is an extended position wherein an end of the elongate member is engaged within a recess in a rim of the manhole; and the second position is a retracted position wherein the end of the elongate member is dis-engaged from the recess in the rim of the manhole.

14. The method of claim 13, wherein the port extends through an upper surface of the cover and pushing is in a direction approximately perpendicular to a plane of the port.

15. The method of claim 13, further comprising aligning the pin member with the port of the cover, by viewing on a monitor, video feed from a camera of the cover-removing apparatus.

16. The method of claim 15, further comprising aligning the held cover with the rim of the manhole, by viewing on the monitor, video feed from the camera of the cover-removing apparatus.

17. The method of claim 13, further comprising rotating an arm of the cover-removing apparatus, to which the magnetic element is attached, in order to perform at least one of:

positioning the magnetic element over the cover;

displacing the held cover from over the manhole;

positioning the cover held by the magnetic element over the manhole; and displacing the magnetic element away from the cover.

18. The method of claim 13, wherein pushing, energizing, de-energizing, moving, lowering and raising are controlled from a remote location.

* * * * *